US005375551A

United States Patent [19]

Lunter et al.

[11] Patent Number: 5,375,551

[45] Date of Patent: Dec. 27, 1994

[54] WATER JET SAUCER

[76] Inventors: Paul Lunter, 5300 Lunter's Way, Punta Gorda, Fla. 33982; Jerry W. Garrison, 4738 Nele St., Northport, Fla. 34287

[21] Appl. No.: 125,738

[22] Filed: Sep. 24, 1993

[51] Int. Cl.[5] ..... B63B 3/00

[52] U.S. Cl. ..... 114/346; 114/145 R; 440/38

[58] Field of Search ..... 114/346, 357, 145 R; 440/6, 38, 39, 40, 41, 42, 43, 44, 47, 84

[56] References Cited

U.S. PATENT DOCUMENTS

| | | | |
|---|---|---|---|
| 1,478,928 | 12/1923 | Toner | 114/145 R |
| 3,718,111 | 2/1973 | Del Vecchio | 114/346 |
| 3,827,387 | 8/1974 | Morgan | 114/346 |
| 4,696,251 | 9/1987 | Spieldiener et al. | 114/346 |
| 4,840,592 | 6/1989 | Anderson | 440/84 |
| 4,942,838 | 7/1990 | Boyer et al. | 440/38 |
| 4,962,717 | 10/1990 | Tsumiyama | 440/87 |

*Primary Examiner*—Stephen P. Avila
*Attorney, Agent, or Firm*—Frank A. Lukasik

[57] ABSTRACT

A water jet propelled saucer shaped water craft having a smoothly curved, convex shaped outer surface comprised of a hull section being slightly radiused from a curved bottom surface up to a circular top, a water jet propulsion system for altering the vertical level and horizontal movement of the craft, an upper body section having a circular bottom edge for mating engagement with said hull section and a joystick control pivotally mounted on said deck for steering and a maneuvering the water craft, said hull section and the upper body section being mated and sealingly joined and secured together with a metal band. The water craft includes a second speed control for controlling the velocity of the water jet stream.

1 Claim, 9 Drawing Sheets

WATER JET SAUCER

BACKGROUND OF THE INVENTION

1. Field of the Invention

The present invention relates generally to water jet boats and more particularly to a water jet boat having a pan-like or saucer-like hull bottom configuration.

2. Description of the Prior Art

Conventional, prior art water jet boats, generally have a narrow body that make the boats feel more like a motorcycle. Literature distributed by such manufacturers generally warn the public that the photographs shown in their brochures show professionals and that the maneuvers should only be tried by skilled professionals and not by the average consumer or boater.

Prior art water jet boats generally have single-chine, concave V-hulls. Because they handle like motorcycles, they are controlled by spring-loaded handle poles which are very similar to the handlebars contained in a motorcycle.

Other prior art water jet boats have a multi-chine concave V-hull which allow a steeper lean into turns while still tracking. The jet boat is alleged to carve through intense corners without any flat sliding or chine wobble. Another feature offered is a raised seat position, nearly four inches higher than conventional machines to put physics to work to allow greater leverage into the turns. Each of the prior art boats stress the comparison with the performance of a motorcycle and the thrills and skills required for operating a motorcycle.

In riding a motorcycle, or a conventional water jet ski boat, great skill and balance are required. They have a narrow beam and require a great deal of skill and balance to mount and start and successfully ride a motorcycle-like water jet boat.

In contrast, several prior art devices disclose the use of saucer-like devices for sliding or coasting on water or snow. U.S. Pat. No. 3,600,001 to Fisher discloses a sled with a ski sled having a dishlike body for a passenger to ride in which is rotatably mounted centrally upon a ski. The ski sled, adapted to be towed behind either a boat or snowmobile on water or snow respectively and has a brake mechanism to releasably lock the dishlike member to the ski, whereby when the brake mechanism is released as the sled is being towed the engagement of the dishlike body member with the towing surface will cause the dish member to rotate relative to the ski.

U.S. Pat. No. 3,901,526 to Scott et al discloses a sled in the form of a hollow body generally in the shape of a shallow saucer having a convexly curved lower surface for engaging and sliding on a snow-covered surface and a manually pivotal control means oriented at the rear of the body operatively associated with a flexible member that extends forwardly alongside the body of the sled and the occupant therein to enable the occupant to control the path of movement of the sled. The control means is in the form of a rudder either single or multiple.

U.S. Pat. No. 5,149,117 to Wilkens, Sr. et al discloses a saucer-shaped toy designed to be utilized alternatively as a swing, a water slide and a snow slide. When used as a water slide, a removable rudder can be used as well as water spray jets or enhanced aesthetic appeal. An upright steering pole can be attached to the saucer with a stiff spring so as to permit the pole to flexibly move to lessen the likelihood of injury to a user under certain situations.

Neither of these prior art saucer-shaped coasters are well adapted for uses other than sleds which may or may not be towed by another power device. The prior art water jet boats are shaped similar to conventional boats with V-hulls and are made with a narrow beam which make the boats relatively unstable to board and prone to capsizing when boarding or in the hands of the typical recreational boater. In contrast, the present invention has a wide beam, and a low center of gravity and relies on a unique hull construction to provide a new and improved water jet saucer which has all the advantages of the prior art water jet boats and none of the disadvantages.

It is therefore an object of the present invention to provide a new and improved saucer-shaped water jet boat which has all of the advantages of the prior art jet ski boats and none of the disadvantages.

It is a further object of the present invention to provide a new and improved saucer-shaped water jet boat which is of durable and reliable construction.

Still another object of the present invention is to provide a new and improved saucer-shaped water jet boat which has a wide beam, a low center of gravity and is highly maneuverable.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

DESCRIPTION OF THE PREFERRED EMBODIMENT

Figure 1:
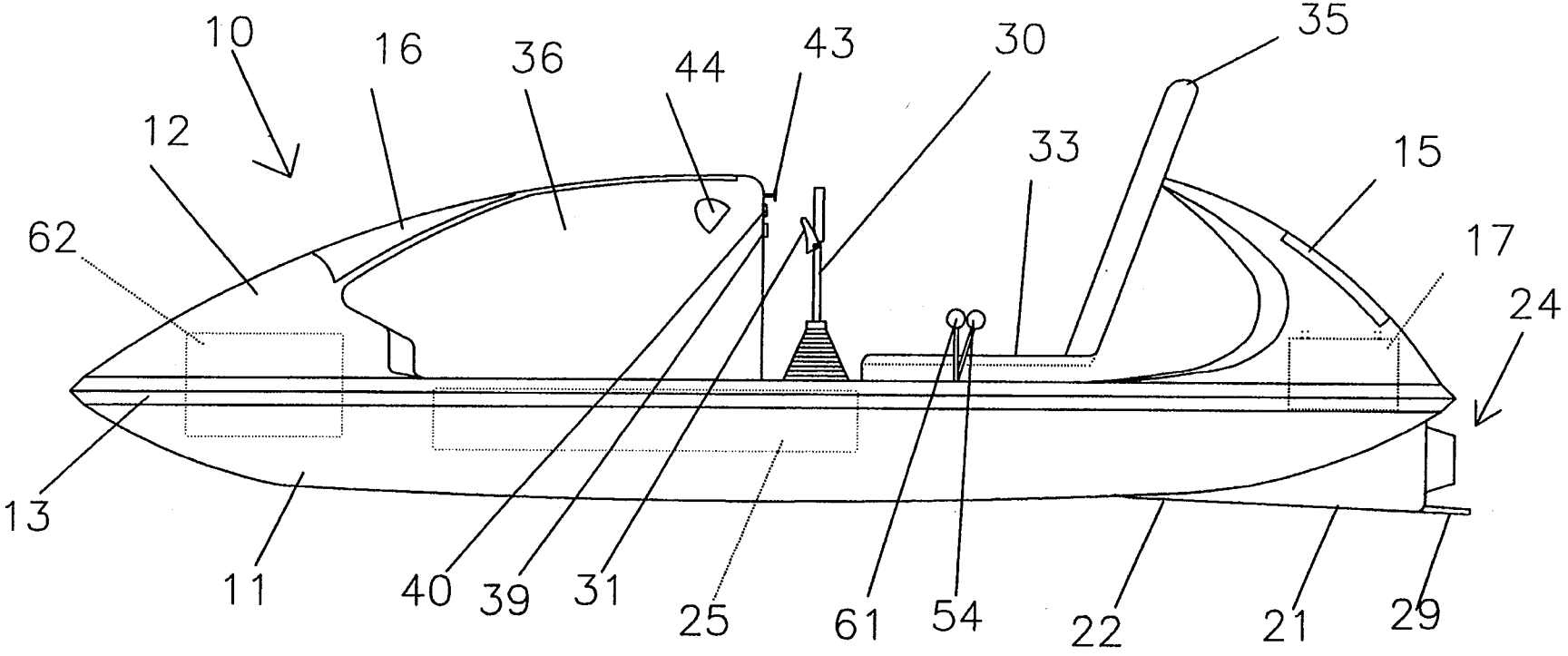
FIG. 1 is a side view of a water jet saucer in accordance with the present invention.
Figure 2:
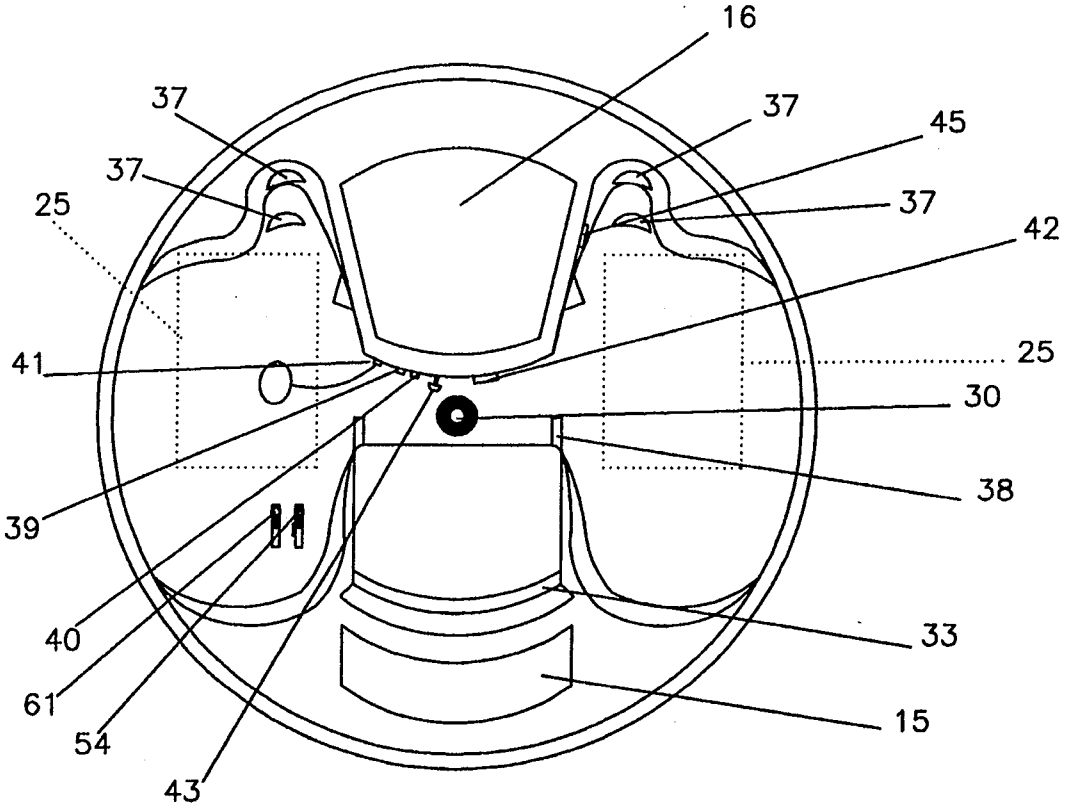
FIG. 2 is a top view of a water jet saucer in accordance with the present invention.
Figure 3:
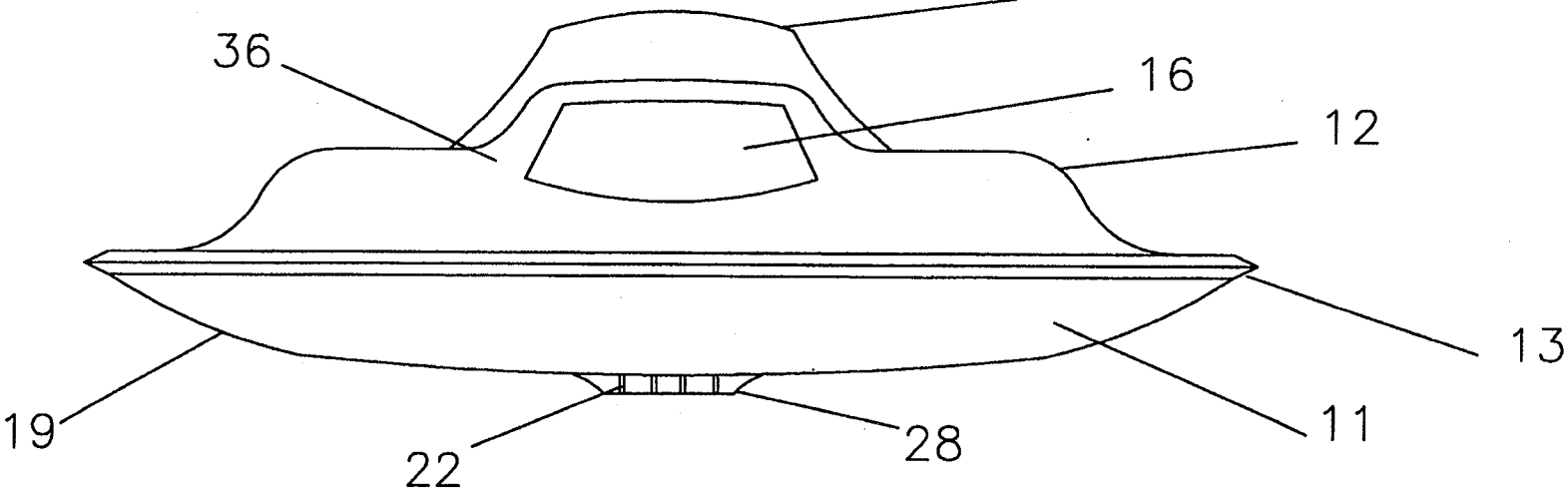
FIG. 3 is a front view of a water jet saucer in accordance with the invention.
Figure 4:
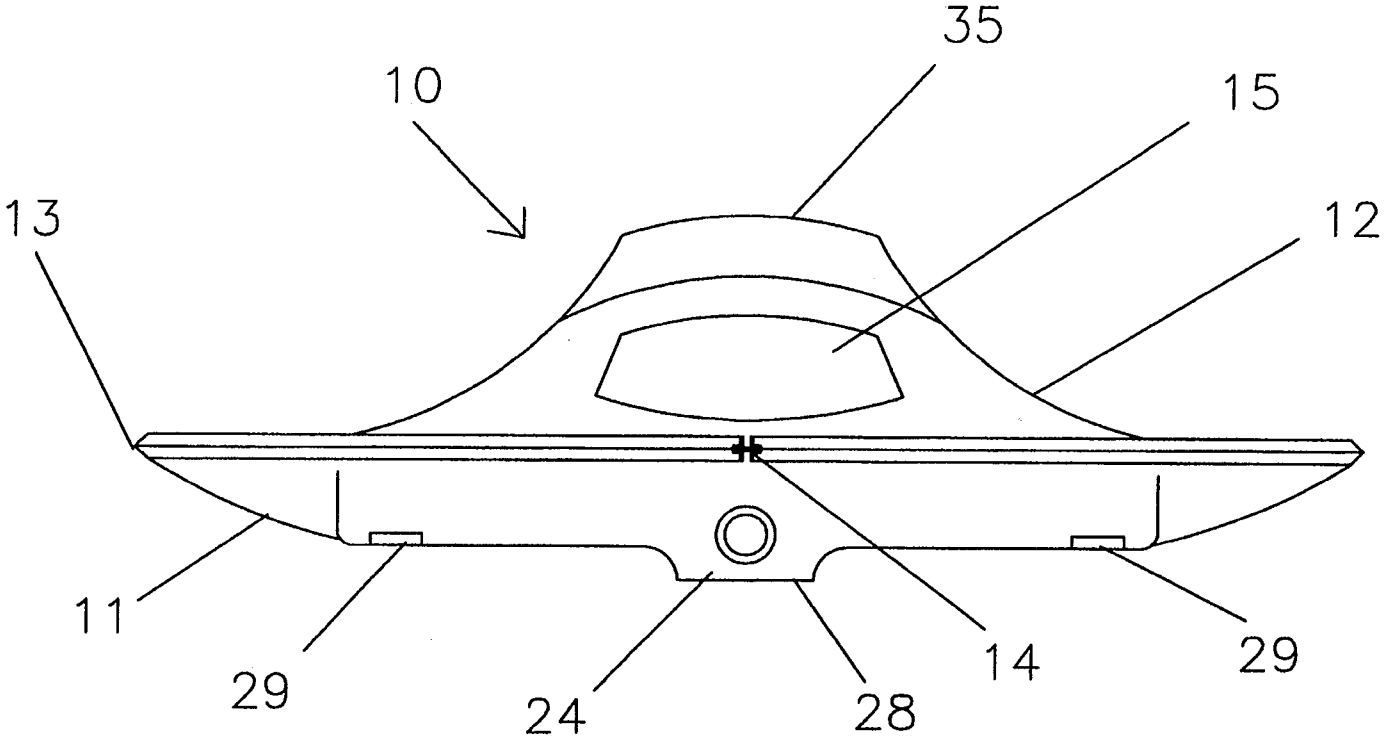
FIG. 4 is a back view of a water jet saucer in accordance with the invention.

The present invention is a water jet propelled, saucer shaped water craft. The water jet saucer is a hybrid boat with features available in a snow saucer and those available in a water jet ski boat. The round saucer shape with smooth radius sides makes the jet saucer have no boundaries. It can spin in circles freely and change directions quickly without having vertical walls to stop smooth travel. The jet saucer of the present invention is propelled by a water jet pump and the direction is controlled by a joystick control. Moving the joystick left or right temporarily will turn the jet saucer in that direction. Moving the joystick left or right and holding it in that position will put the jet saucer in a spin. Because the jet saucer is round with a round bottom and radius, side turns will be smooth while being more exciting.

Moving along in a straight line (not necessarily forward) and moving the joystick left or right, the jet saucer will slice in the previous direction before executing the desired turn or spin. The throttle is conveniently located on the joystick so that the operator can control the speed with a finger. The shell (hull) will be fabricated of either fiberglass or polycarbonate for strength and resiliency. Polycarbonate can take a hard blow without breaking. There will also be adjustable scags for well controlled forward movement as well as turns.

To understand the improvements afforded by the present invention, initial reference is made to FIGS. 1 through 4 wherein numeral 10 generally indicates the water jet saucer of the present invention. The water jet saucer 10 generally comprises two main sections, the saucer (dish) shaped hull 11, and the upper body (fuselage) 12 which are mated together, sealed with a rubber or plastic gasket and joined securely by wrapping a steel band 13 fastened with screw 14. Upper body 12 has two access panels, with battery access provided by panel 15, and engine access provided by panel 16. Battery 17, located in the aft section of the upper body 12 is readily accessible through panel 15. Engine 18, located in the engine compartment of upper body 12 is readily accessible through panel 16.

The bottom surface 19 of hull 11 is gently radiused from a curved bottom surface up the sides to its top edge and is generally of saucer-like configuration so that the hull 11 has a convexly curved forward and side portions sloping gradually upwardly to facilitate sliding movement of the hull over the water surface and which may be symmetrical from end-to-end with the rear portion 20 of the bottom surface flattened out to the stern for controlling the path of movement and stabilizing its movement characteristics. In essence, the curved bottom surface and the flattened surface 21, starting aft of the midpoint of the hull, acts to maintain the level of the hull in a horizontal position with an operator on board and acts as a shallow skeg to prevent some sliding motion. Furthermore, the flattened surface provides a mounting surface for the water intake 22 and a housing for the water pump 23 and for the water jet discharge nozzle 24.

The water jet forced through the water jet nozzle 24 directs and pushes the saucer 10 on the surface of the water. Direction control is provided by the joystick 30 which, through a cable linkage, turns jet nozzle 24, 30° to the left or 30° to the right. Jet nozzle 24 may also be directed upwardly 15° or downwardly 15° from a horizontal position. In a particular embodiment, engine 18 was a 2 cycle, 30 horsepower engine which was used to power the water pump 23 which draws water through the water intake 22 located on the bottom of flattened surface 21. A throttle 31, is connected to the joystick 30 so that the rider can adjust the engine 18 speed with finger tip control. The engine 18 and the exhaust are water cooled by using a water line from the pressure side of the water pump 23 housing. Any bilge water is removed by a suction line coming off the jet discharge nozzle 24. The faster the engine 18 turns, the faster the water pump 23 turns, the more water is forced through water jet discharge nozzle 24, the faster the saucer 10 moves. Tabs 29 may be formed on either side of the rear portion 20. Tabs 29 may be fabricated from fiberglass as the hull 11 is being formed either through hand layup or the tabs 29 may be made from aluminum or stainless steel and fastened to the hull 11.

The saucer shaped hull 11, of a typical water jet saucer 10, may have a diameter of six feet (72"). The draft, the distance from the top of the saucer hull 11 to the lowest, or center point, may be 7 inches. The width of the flattened surface 21 may be 48". The distance from the bottom of the steel band 13 to the bottom surface of flattened surface 21 may be 4½". The distance from the flattened surface 21 to the lowest surface 28 is 2".

The saucer-like hull 11, enables the saucer 10 to turn in any direction freely, including spinning in a circle. Controlling the saucer 11 is done by moving the joystick 30 temporarily to the left to make the saucer 10 turn left. Moving the joystick 30 to the left, and holding it there, will put the saucer 10 in a spin to the left. Moving the joystick 30 to the right, and holding it there, will put the saucer 10 in a spin to the right. A first time rider can quickly feel comfortable and in control, while experts can still be challenged by making hard sharp turns that will slide temporarily before turning, making turns more challenging. By installing a larger engine 18, the ride can even be more challenging.

The upper body 12 and the hull 11 may be fabricated using the normal, conventional hand-layup method using fiberglass reinforced resin, molded polycarbonates, or high impact plastics. The rider sits firmly in a molded seat 33 that has a high contoured back and is tilted back for comfort and stability. The rider sits just above the water level keeping the center of gravity low for better stability. The rider is also positioned in the center of the saucer 10 with no part of the body protruding past the outer edges of the saucer 10. This safety feature will prevent any body injury if the rider were to bump into any object. The stepping area 34, for mounting the saucer 10 has a non-skid surface.

The rider sits firmly in a molded seat 33 that has a high contoured back 35 which is tilted back for comfort and stability. The rider's legs are slightly spread to go around the engine housing 36, and the feet are placed in one of two sets of foot holders 37 that are angled to securely hold each foot. With the excellent back, buttocks, and foot support, the rider will be completely relaxed because it is not necessary for them to use any strength to hold the rider in place. For shorter or taller riders, the molded seat 33 is mounted on slide brackets 38 and can be readily adjusted.

An ON/OFF switch 39, start button 40, emergency stop 41, wrist band connection choke button 43 and gas gauge 42 are easily seen and accessible on the engine housing 36.

The engine 18 may be mounted on suitable spars, or engine base mounts 26, formed within hull 11. Dry storage compartments 25 may be provided within the hull 11 on either or both sides of the centerline. The compartments 25 may be used to store personal items, or as a cooler, or to store a fire extinguisher.

On the sides of the engine housing 36 are two air vents 44. The gas filler neck 45 is located on the side of the engine housing 36 and is connected to fuel tank 62. The entire upper body 12 may be removed for any major work to expose all of the internal parts for service or replacement.

An additional feature provided by the present invention is a second speed option. A speed control valve 46 is fastened to the water jet pump outlet 47. The valve 46 comprises a top half 48 and a bottom half 49 each pivotally fastened to the mounting ring 50 by hinges 51. The two valve halves 48 and 49 are linked together by curved rack and gear 52 formed on the outer edges of top half 48 and bottom half 49. Speed shift cable 53, may be controlled by lever 54. Speed control valve 46 is normally open, which permits the water jet exiting the water pump 23 to be directed by water jet nozzle 24 at the design pressure and volume. Speed control valve 46 is designed primarily to provide a higher speed by constricting the water jet stream into a narrower stream and thereby increasing the pressure of the water jet stream and consequently increasing the speed of the saucer 10. Having a second speed option is especially important in the event of threatening weather when the rider needs to get under way quickly. When the second level (higher range) speed is required, the rider pulls the speed shift lever 54, which in turns pulls speed shift cable 53 which rotates top half 48 and bottom half 49 to narrow the water jet opening and thus increasing the pressure of the water jet and in turn the speed of the saucer 10.

Figure 5:
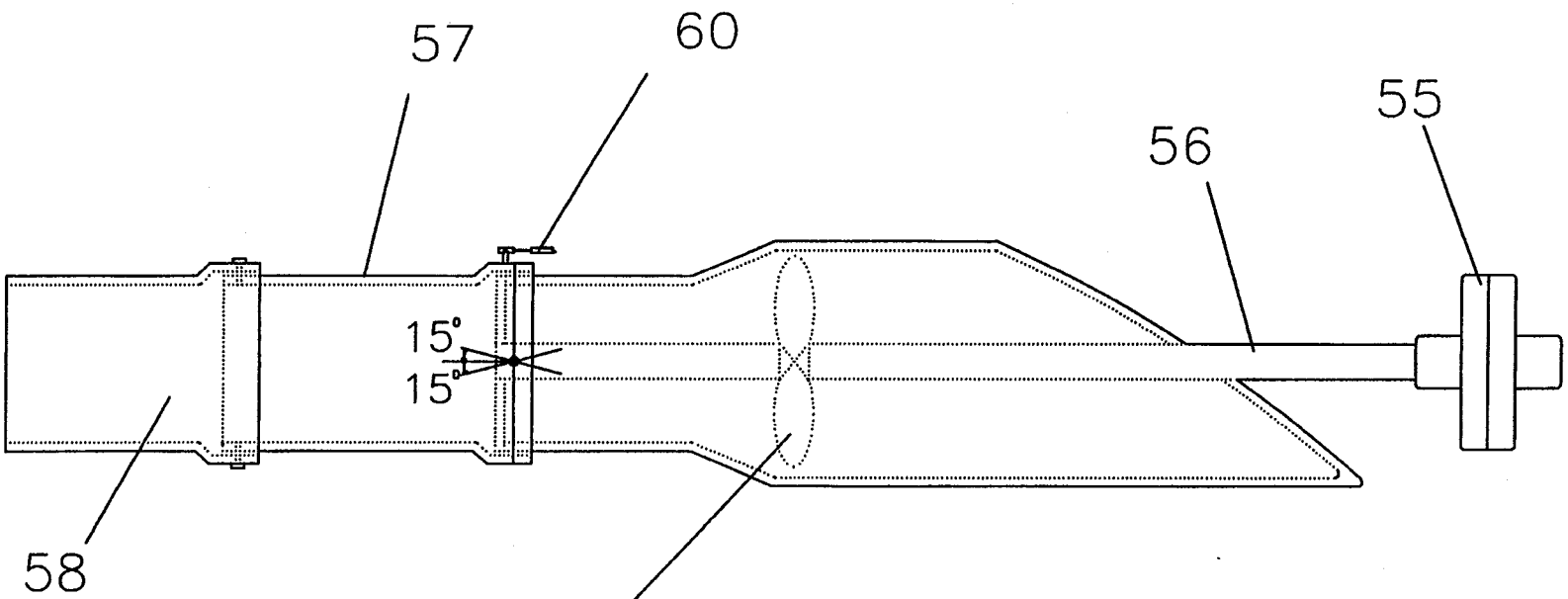
FIG. 5 is a side view of a propulsion system of the present invention.
Figure 6:
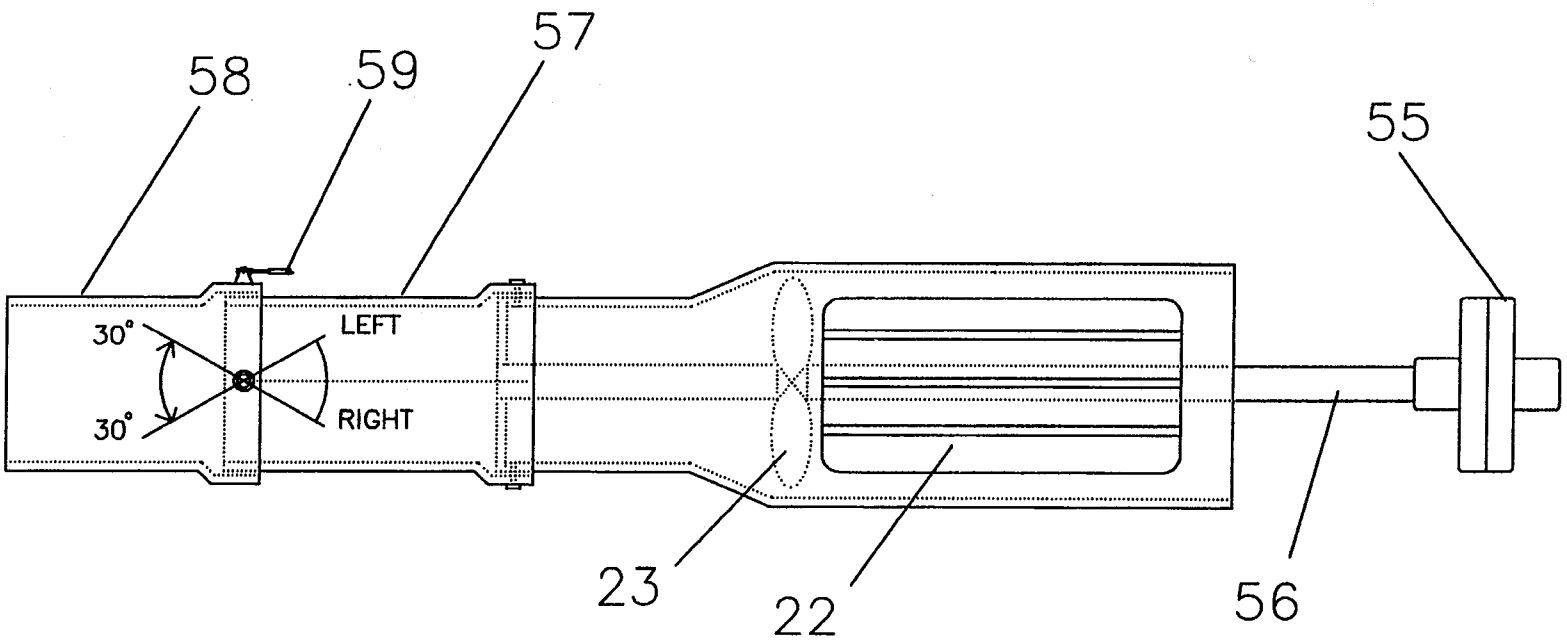
FIG. 6 is a bottom view of a propulsion system of the present invention.
Figure 7:
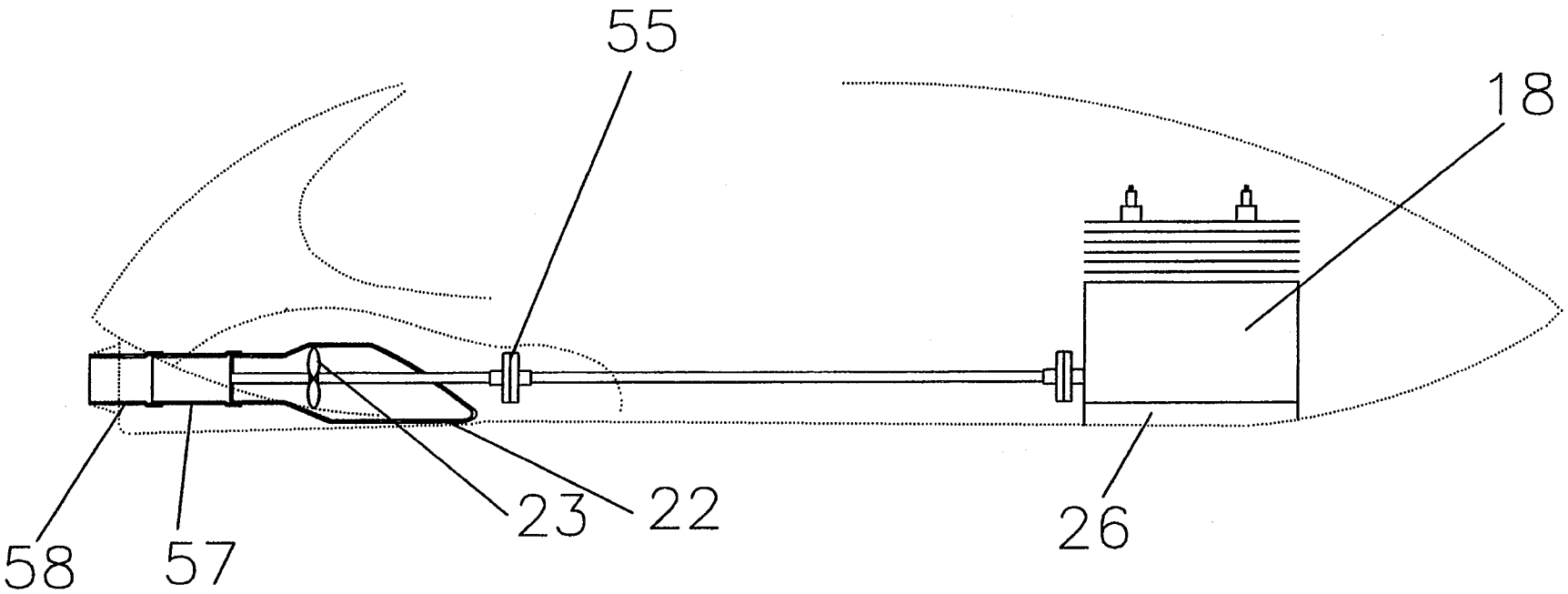
FIG. 7 is a side view, partially in section, of the propulsion system installed in a water jet saucer in accordance with the present invention.
Figure 8:
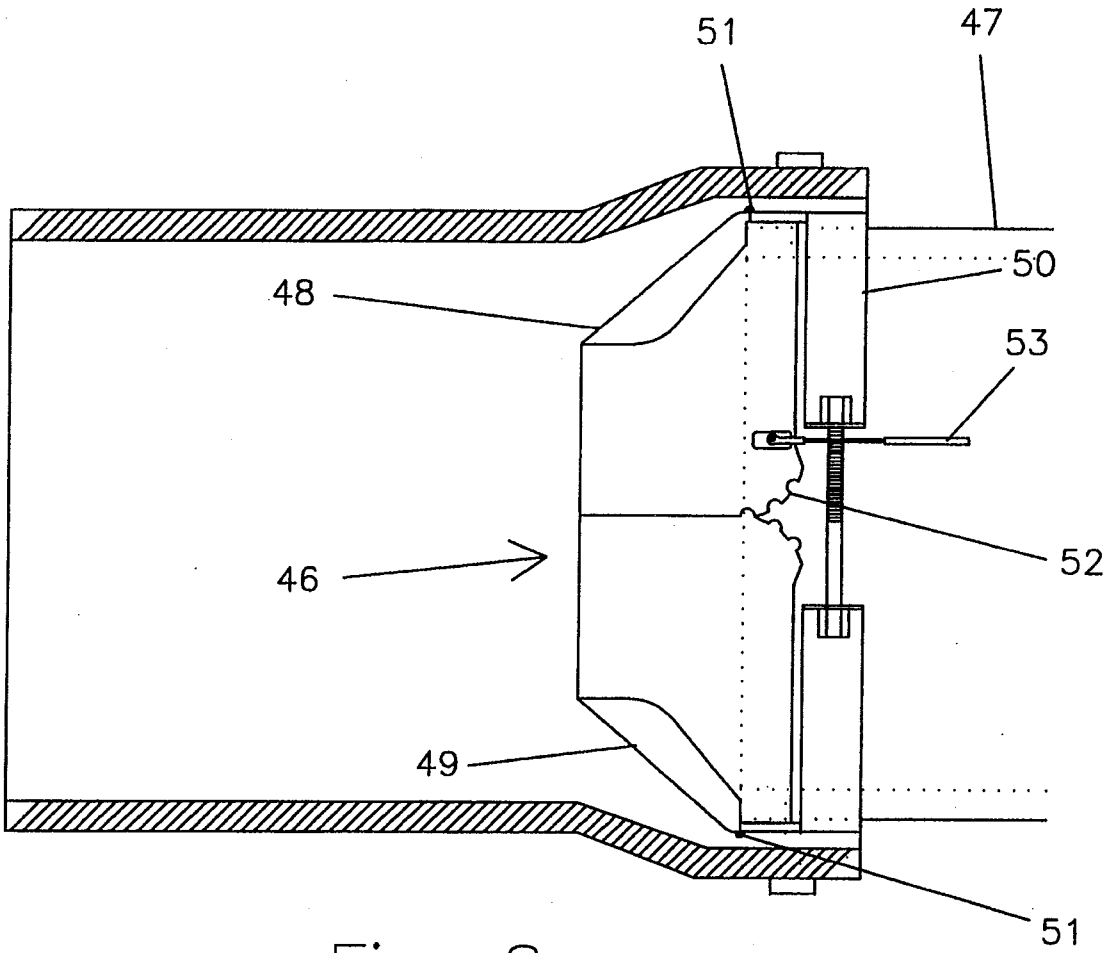
FIG. 8 is a side view of a speed valve installed within the propulsion system.
Figure 9:
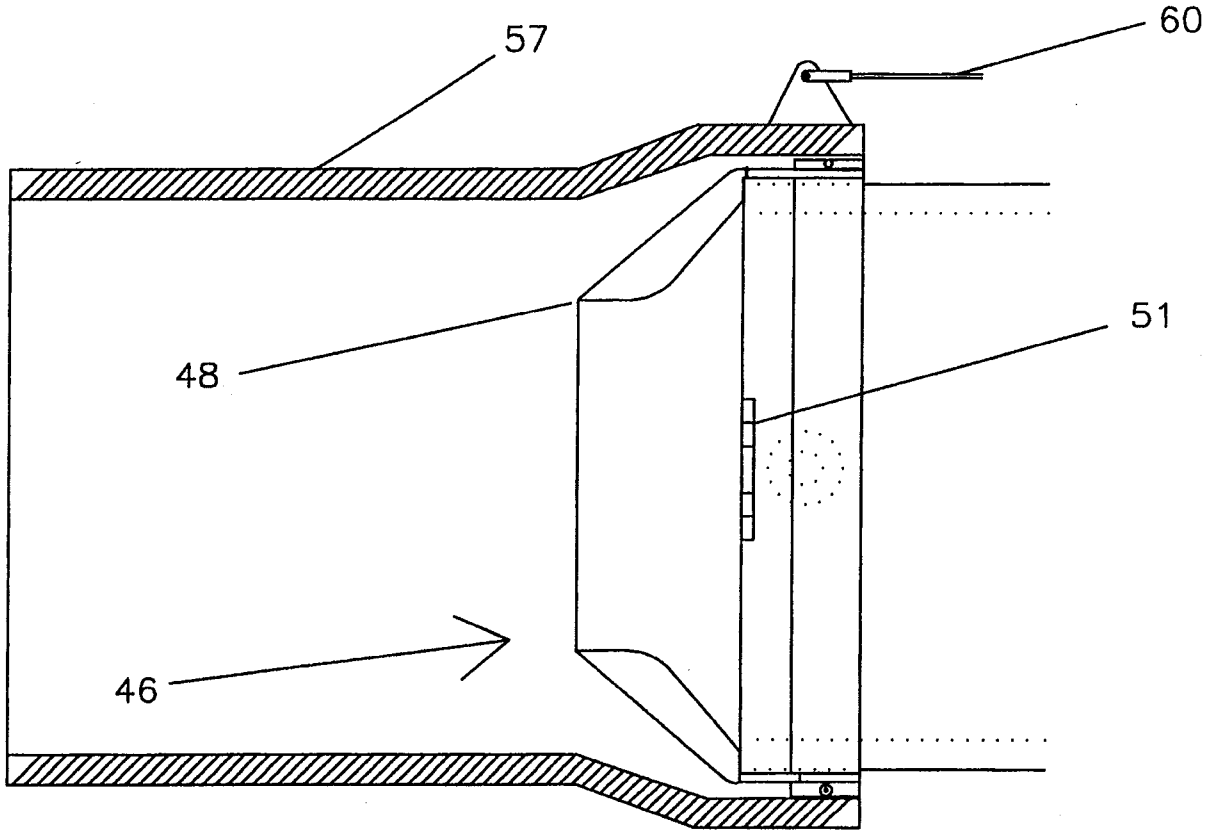
FIG. 9 is a top view of a speed valve installed within the propulsion system.

FIGS. 5 and 6 show detail views of the water jet system which comprises the drive shaft coupling 55, the drive shaft 56, water intake 22, water pump 23, trim nozzle 57, and steering nozzle 58. Steering nozzle 58 is controlled by steering cable 59 which is connected to joystick 30. Steering nozzle 58 is pivoted to sweep 30° from center, to either left or right, a total of 60°. Trim nozzle 57 is controlled by trim cable 60 which is connected to trim lever 61. Trim nozzle 57 is pivoted to sweep 15° from horizontal, to either up or down positions.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

What is claimed is:

1. A water jet propelled, saucer shaped, water craft comprising:

a high performance, round bottom hull, having a smoothly curved, convex shaped, outer round bottom surface and a circular top, said hull having convexly curved forward, side, and aft portions slightly radiused from said round bottom surface up to said circular top, and said curved round bottom surface flattened out starting aft of a midpoint of said hull and continuing rearwardly to a flat vertical surface extending upwardly to said radiused hull, thereby forming a housing for propulsion means, a water jet propulsion means affixed to the interior of said hull on said curved bottom surface, said propulsion means having an engine, a water intake, a water pump, and jet nozzle means for altering the vertical level, speed, and horizontal movement of said water craft, said jet nozzle means having a top half and a bottom half pivotally fastened to said jet nozzle means, said top half and said bottom half being linked together by a curved rack and gear formed on respective halfs for providing a variable sized opening, and controlled by a speed control means for controlling the velocity of said water jet by reducing the volume of water and increasing the pressure of the water jet and thereby increasing the speed of said water craft, an upper body having;

a circular edge for mating engagement with said hull circular top, an engine housing, a molded, high contoured seat back, a seat positioned near the center of said circular bottom edge, a non-skid deck, angled foot holders placed on said deck, on opposite sides of said engine housing, control panel means for starting, stopping, and monitoring said water craft, and joystick control means pivotally mounted on said deck for steering and maneuvering said water craft, said hull and said upper body being mated and sealingly joined together and secured together with a metal band.

* * * * *